US005800093A

United States Patent [19]

Khachaturian

[11] Patent Number: 5,800,093

[45] Date of Patent: Sep. 1, 1998

[54] METHOD AND APPARATUS FOR THE OFFSHORE INSTALLATION OF MULTI-TON PACKAGES SUCH AS DECK PACKAGES, JACKETS, AND SUNKEN VESSELS

[76] Inventor: Jon E. Khachaturian, 5827 Rhodes Ave., New Orleans, La. 70131

[21] Appl. No.: 709,014

[22] Filed: Sep. 6, 1996

Related U.S. Application Data

[63] Continuation-in-part of Ser. No. 615,838, Mar. 14, 1996, Pat. No. 5,662,434, which is a continuation-in-part of Ser. No. 501,717, Jul. 12, 1995, Pat. No. 5,607,260, which is a continuation-in-part of Ser. No. 404,421, Mar. 15, 1995, Pat. No. 5,609,441.

[51] Int. Cl.[6] ..... E02B 17/00

[52] U.S. Cl. ..... 405/204; 114/51; 405/209

[58] Field of Search ..... 405/204, 209, 405/203, 196; 114/44, 51, 50

[56] References Cited

U.S. PATENT DOCUMENTS

| | | | |
|---|---|---|---|
| 928,536 | 7/1909 | Pino | 114/51 |
| 1,710,103 | 4/1929 | Nelson | 114/51 |
| 2,598,088 | 5/1952 | Wilson | 61/46 |
| 3,977,346 | 8/1976 | Natvig et al. | 114/65 R |
| 4,242,011 | 12/1980 | Karsan et al. | 405/204 |
| 4,249,618 | 2/1981 | Lamy | 405/204 X |
| 4,252,468 | 2/1981 | Blight | 405/204 |
| 4,252,469 | 2/1981 | Blight et al. | 405/204 |
| 4,714,382 | 12/1987 | Khachaturian | 405/204 |
| 4,744,697 | 5/1988 | Coppens | 405/204 |
| 5,037,241 | 8/1991 | Vaughn et al. | 405/209 |

*Primary Examiner*—Hoang C. Dang
*Attorney, Agent, or Firm*—Pravel, Hewitt & Kimball

[57] ABSTRACT

A method and apparatus for the installation or removal of large multi-ton prefabricated deck packages includes the use of usually two barges defining a base that can support a large multi-ton load. A variable dimensional truss assembly is supported by the barge and forms a load transfer interface between the barge and deck package. Slings are suspended from a compression frame portion at the boom end portions of the truss assembly. The slings form attachments between the compression frame and the deck package at the upper elevational positions on the deck package. Tensile connections form attachments between the deck package and barge at a lower elevational position. The variable dimension truss includes at least one member of variable length, in the preferred embodiment being a winch powered cable that can be extended and retracted by winding and unwinding the winch.

17 Claims, 11 Drawing Sheets

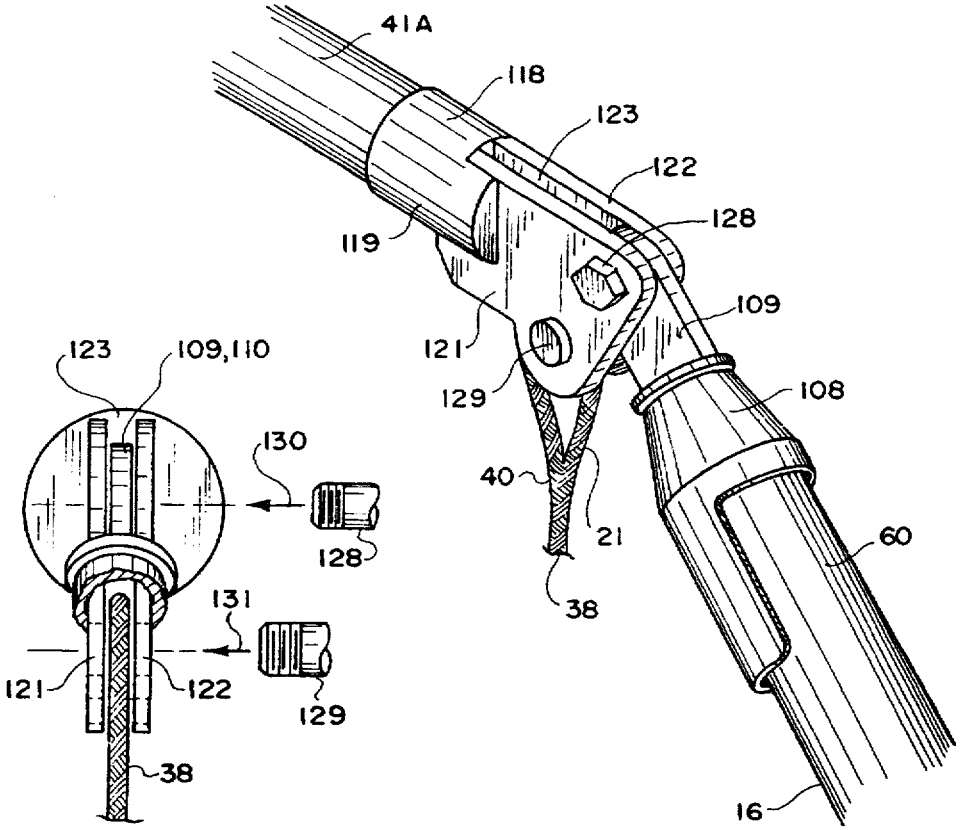
FIG. 5
FIG. 4
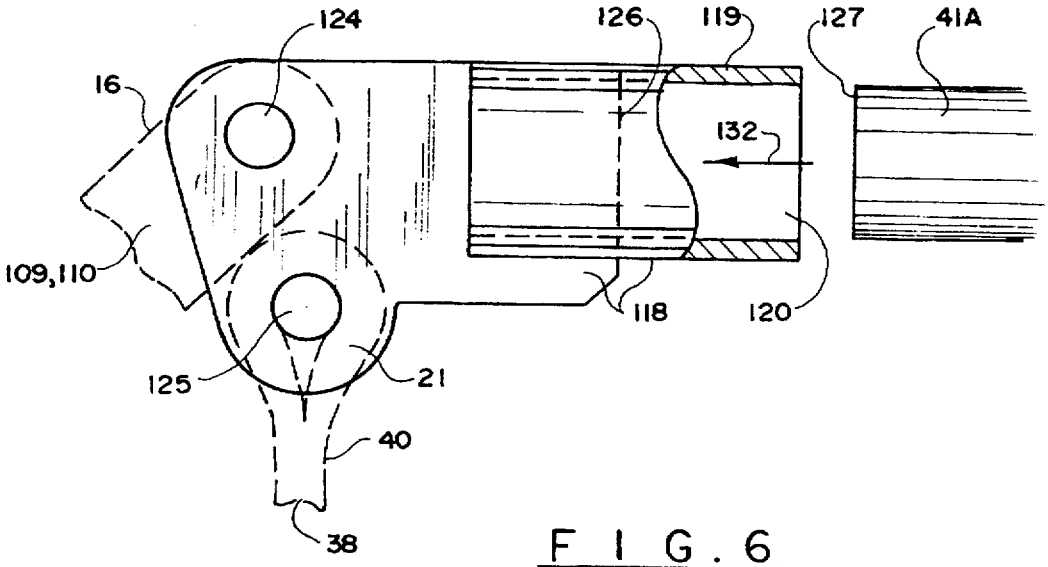
FIG. 6

METHOD AND APPARATUS FOR THE OFFSHORE INSTALLATION OF MULTI-TON PACKAGES SUCH AS DECK PACKAGES, JACKETS, AND SUNKEN VESSELS

CROSS REFERENCE TO RELATED APPLICATIONS

This is a continuation-in-part of U.S. Pat. application Ser. No. 08/615,838, filed Mar. 14, 1996, now U.S. Pat. No. 5,662,434 which is a continuation-in-part of U.S. Pat. application Ser. No. 08/501,717, filed Jul. 12, 1995, now U.S. Pat. No. 5,607,260 which is a continuation-in-part of U.S. application Ser. No. 08/404,421 filed Mar. 15, 1995, now U.S. Pat. No. 5,609,441, each of which is hereby incorporated herein by reference.

BACKGROUND OF THE INVENTION

1. Field of the Invention

The present invention relates to the placement of large multi-ton prefabricated deck packages (e.g. oil and gas platforms, oil rigs) in an offshore environment upon a usually partially submerged jacket that extends between the seabed and the water surface. Even more particularly, the present invention relates to the use of a moving lifting assembly which is preferably barge supported that can place a very deck package upon an offshore marine jacket foundation without the use of enormous lifting booms such as form a part of derrick barges, offshore cranes, and the like, and wherein opposed short booms are connected with a frame or compressive spreader members that enable use of suspended slings to lift the deck package 2. General Background In the offshore oil and gas industry, the search for oil and gas is often conducted in a marine environment. Sometimes the search takes place many miles offshore. Oil and gas well drilling takes place in many hundreds of feet of water depth.

The problem of drilling oil wells offshore and then producing these wells has been solved in part by the use of enormous fixed or floating platform structures with foundations that are mostly submerged, but usually extending a number of feet above the water surface. Upon this foundation (or "jacket", tension leg platform ("TLP"), or SPAR, etc. as it is called in the art) there is usually placed a very large prefabricated rig or deck platform. The term "deck platform" as used herein should be understood to include any of a large variety of prefabricated structures that are placed on an offshore foundation to form a fixed or floating offshore platform. Thus, a "deck-platform" can include, e.g. a drilling rig, a production platform, a crew quarters, living quarters, or the like.

As an example of one offshore foundation, a supporting jacket is usually a very large multi-chord base formed of multiple sections of structural tubing or pipe that are welded together. Such jackets have been used for a number of years for the purpose of supporting large deck platforms in an offshore environment.

The jacket or foundation is usually prefabricated on land in a fabrication yard, preferably adjacent to a navigable waterway. The completed jacket can be placed upon a large transport barge so that it can be moved to the drill site where it will be placed upon the ocean floor. As an example, an offshore jacket can be several hundred feet in length. The size of the jacket is of course a function of the depth of water in which the rig will be placed. A five hundred (500) foot water depth at the drill site (or production site) will require a jacket which is approximately 500–550 feet tall. The jacket is usually partially submerged, with only a small upper portion of the jacket extending slightly above the water surface. An offshore jacket as described and in its position on the seabed can be seen, for example, in the Blight, et al U.S. Pat. No. 4,252,469 entitled "Method and Apparatus for installing integrated Deck Structure and Rapidly Separating Same from Supporting Barge Means." Specifically, FIGS. 1, 2 and 3 of the Blight, et al patent show an offshore jacket on the seabed.

A small upper portion of the jacket extends above the water surface. This exposed portion of the jacket is the portion upon which the "deck platform" is placed and supported by. This upper portion of the jacket is usually equipped with a number of alignment devices which enhance the proper placement of the deck package on the jacket. Such alignment devices are referred to variously as stabbing eyes, sockets, or the like. The use of such alignment devices, sockets, or stabbing eyes can be seen in the Blight, et al U.S. Pat. Nos. 4,252,468 and 4,252,469 as well as in the Kansan U.S. Pat. No. 4,242,011. For purposes of background and reference, the Kansan U.S. Pat. No. 4,242,011 is incorporated herein by reference. The Blight, et al U.S. Pat. Nos. 4,252,469 and 4,252,468 are likewise each incorporated herein by reference.

Deck platforms or topsides can be extremely large and have correspondingly heavy weights. For example, it is not uncommon for a deck platform such as a drilling rig crew quarters, production platform or the like to be between five hundred and five thousand (500 and 5,000) tons gross weight. Topsides in excess of ten thousand (10,000) tons have been installed, and others that are being planned may weigh as much as thirty thousand (30,000) tons. Such enormous load values present significant problems in the placement of deck platforms on offshore jacket structures. First, the placement is done entirely in a marine environment. While the jacket can be laid on its side and/or floated into position, the platform is not a submersible structure, and must be generally supported in an upright condition above the water surface to prevent water damage to the many components that form a part of the drilling or production platform (such as electrical systems, wall constructions, and other portions that will be inhabited by individuals and used as oil and gas well drilling or production equipment).

The art has typically used enormous derrick barges for the purpose of setting or placing deck packages on jackets in an offshore environment. These derrick barges are large, rectangular barge structures with a high capacity lifting boom mounted at one end portion of the deck of the barge. The barge, for example might be three hundred to four hundred (300–400) feet in length, fifty to seventy five (50–75) feet in width, and twenty-five to fifty (25–50) feet deep. These figures are exemplary.

A derrick barge might have a lifting capacity of for example, two thousand (2,000) tons. For very large structures such as for example, a five thousand (5,000) ton deck package, two derrick barges can be used, each supporting one side portion of the deck platform with a multi-line lift system supported by an enormous structural boom extending high into the air above the package during the lift.

The boom simply works in the same way as an anchor lifting boom, namely the loadline raises and/or lowers the package into its proper position upon the jacket. While the use of such derrick barges has been very successful in the placing of offshore deck packages on jackets through the years, such derrick barges are generally limited in their capacity to packages of two thousand (2,000) tons or less. Further, derrick barges of such an enormous capacity are extremely expensive to manufacture and operate. Many thousand of dollars per hour as a cost of using such a device is not uncommon. Although there are five (5) or six (6) derrick barges that can lift in excess of six thousand (6,000) tons, they are extremely costly and limited as to the water depth in which they can operate.

However, when very large loads of, for example six thousand-ten thousand (6,000–10,000) tons are involved, the limitation of the derrick barge usually prohibits such a placement on an offshore jacket. The topside must then be pieced and finished offshore.

In U.S. Pat. No. 4,714,382 issued to Jon Khachaturian there is disclosed a method and apparatus for the offshore installation of multi-ton prefabricated deck packages on partially submerged jacket foundations. The Khachaturian patent uses a variable dimensional truss assembly is supported by the barge and forms a load transfer interface between the barge and the deck package. Upper and lower connections form attachments between the truss members and the deck package at upper and lower elevational positions on the deck package. The variable dimension truss includes at least one member of variable length, in the preferred embodiment being a winch powered cable that can be extended and retracted by winding and unwinding the winch. Alternate embodiments include the use of a hydraulic cylinder as an example.

An earlier patent, U.S. Pat. No. 2,598,088 issued to H. A. Wilson entitled "Offshore Platform Structure and Method of Erecting Same" discusses the placement of drilling structure with a barge wherein the legs of the drilling structure are placed while the drilling structure is supported by two barges. The Wilson device does note use truss-like lifting assemblies having variable length portions which are placed generally on opposite sides of the deck package. Rather, Wilson relates to a platform which is floated in place and the support legs are then placed under the floating platform. Thus, in the Wilson reference, an in-place underlying supporting jacket is not contemplated.

The Natvig, et al U.S. Pat. No. 3,977,346 discusses a method of placing a deck structure upon a building site such as a pier. The method includes the pre-assembly of a deck structure upon a base structure on land so that the deck structure extends outwardly over a body of water. Floating barges are provided for supporting the deck structure outwardly of the building site. The deck structure is then transferred to the supportive base structure by means of barges. The Natvig reference uses two barges which are placed on opposite sides of a platform with pedestal type fixed supports forming a load transfer member between the barges and the platform. However, the fixed pedestal of Natvig is unlike the truss-like lifting arrangement of applicant which include movable portions at least one of which can be of a variable length.

SUMMARY OF THE INVENTION

The present invention provides an improved method and apparatus for the lifting and/or placement of a multi-ton package such as a deck package, jacket, or sunken vessel. Also the present invention provides an improved method and apparatus for the removal of a multi-ton package from the ocean floor (i.e., sunken vessel) or from an offshore jacket.

The present invention discloses an improvement to the variable dimension truss assembly disclosed in U.S. Pat. No. 4,714,382 incorporated herein by reference.

The apparatus includes one or more barges defining a base that supports the large multi-ton load of the deck package.

In the preferred embodiment, truss-like lifting device includes a barge mounted on each side of the deck package to be lifted during operation.

In the preferred embodiment, two barges are used respectively, each having a truss-like lifting device on its upper deck surface. The truss preferably includes inclined and opposed booms mounted on each barge, a compression member or frame that spans between and is pinned to the top of each boom and a horizontal chord member of variable length that employs a cable wound upon a winch on each barge so that the cross-sectional dimensions of the truss can be varied by paying out or reeling in cable from the winch.

The truss forms a load transfer between each barge and the package to be lifted (e.g., deck package, sunken vessel, or jacket) and/or placed. Upper and lower connections are formed between the lifting truss and the deck package at respective upper and lower elevational positions.

Power is provided, preferably in the form of the winch mounted on each barge for changing the length of the horizontal chord, variable length member of the truss so that elevational position of the deck package with respect to the barge can be varied such as during a lifting or lowering of the package (such as to or from a jacket foundation).

In the method of the present invention, the multi-ton deck package is first transported on a transport barge to the site where it will eventually assist in the drilling oil and/or production of a well.

In the preferred embodiment, a lifting assembly is attached to the package on generally opposite sides of the package and at upper and lower positions.

One element of the truss-like lifting assembly preferably includes a movable horizontal chord portion which has a variable length. In the preferred embodiment, the movable portion is a winch powered cable extending from each winch to a padeye connection on the package to be lifted or lowered, wherein the cable can be extended or retracted between the lift barge and the deck package being lifted or lowered.

In the preferred embodiment, two lift barges support respectively a pair of truss-like lifting assemblies which in combination with the package form an overall truss arrangement. That is, the deck package itself can form a portion of the truss during the lift (typically carrying tension), and may carry both compression and tension loads.

In the preferred embodiment, the truss-like lifting assemblies have booms on each barge that are connected at their upper end portions with a compression frame or spreader bar arrangement. Slings are suspended from the compressions frame to the package, eliminating lateral forces on the top portion deck package. The slings can extend from a compression frame or spreader bars to lifting eyes on the top portion of the deck package.

The truss-like lifting assemblies and slings support the package and can elevate it above the surface of any transport barge, so that the transport barge can be removed as a support for packages such as jackets or deck packages. This allows the package to be placed vertically above a jacket foundation or partially submerged foundation (in the case of a deck package) and aligned with the foundation so that the deck package can be placed upon the foundation by lowering. In the case of a jacket, the transport barge can be removed so that the jacket can be lowered into the water and floated prior to installation.

The present invention allows a dimensional change in the cross-sectional configuration of the truss with respect to a vertical cross section of the truss and provides a means of raising and lowering the selected package.

As an improvement, the present invention provides a compression frame, compression member, or spreader bar arrangement that allows the lifting barges and the lifting booms attached thereto to attach to the package being lifted with vertical slings. The slings allow attachment to multiple points on the package without substantial structural modification or reinforcement. Such is important for example during some salvage operations. If a sunken barge is below the water surface, slings can extend to connections below the water or at the water surface. Thus, objects can be lifted even if connections must be made at or below the waters surface. Further, the lifting booms can remain in an inclined position where their lifting capacity is maximized.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein:

FIG. 4 is a fragmentary perspective view of a second embodiment of the apparatus of the present invention illustrating the connection between the compression members, boom and sling;

FIG. 5 is a fragmentary end view of a second embodiment of the apparatus of the present invention illustrating the connection between the compression member, boom and sling;

FIG. 6 is a fragmentary elevational view of the second embodiment of the apparatus of the present invention illustrating the compression member, boom and sling;

DETAILED DESCRIPTION OF THE PREFERRED EMBODIMENT

Figure 1:
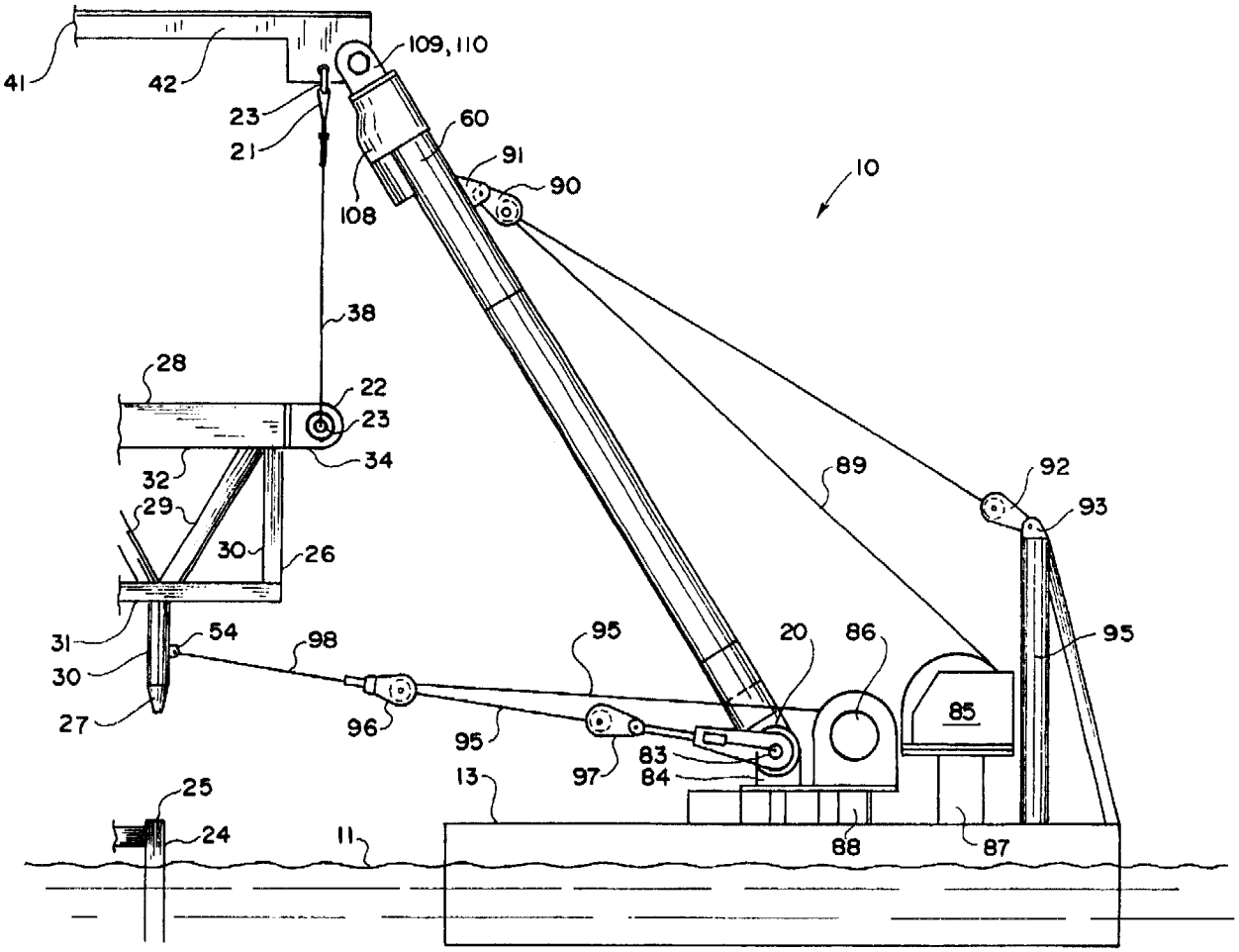
FIG. 1 is a partial, side elevational view of the preferred embodiment of the apparatus of the present invention illustrating the deck package being supported in an elevated position above the jacket to which the platform will be attached.
Figure 2:
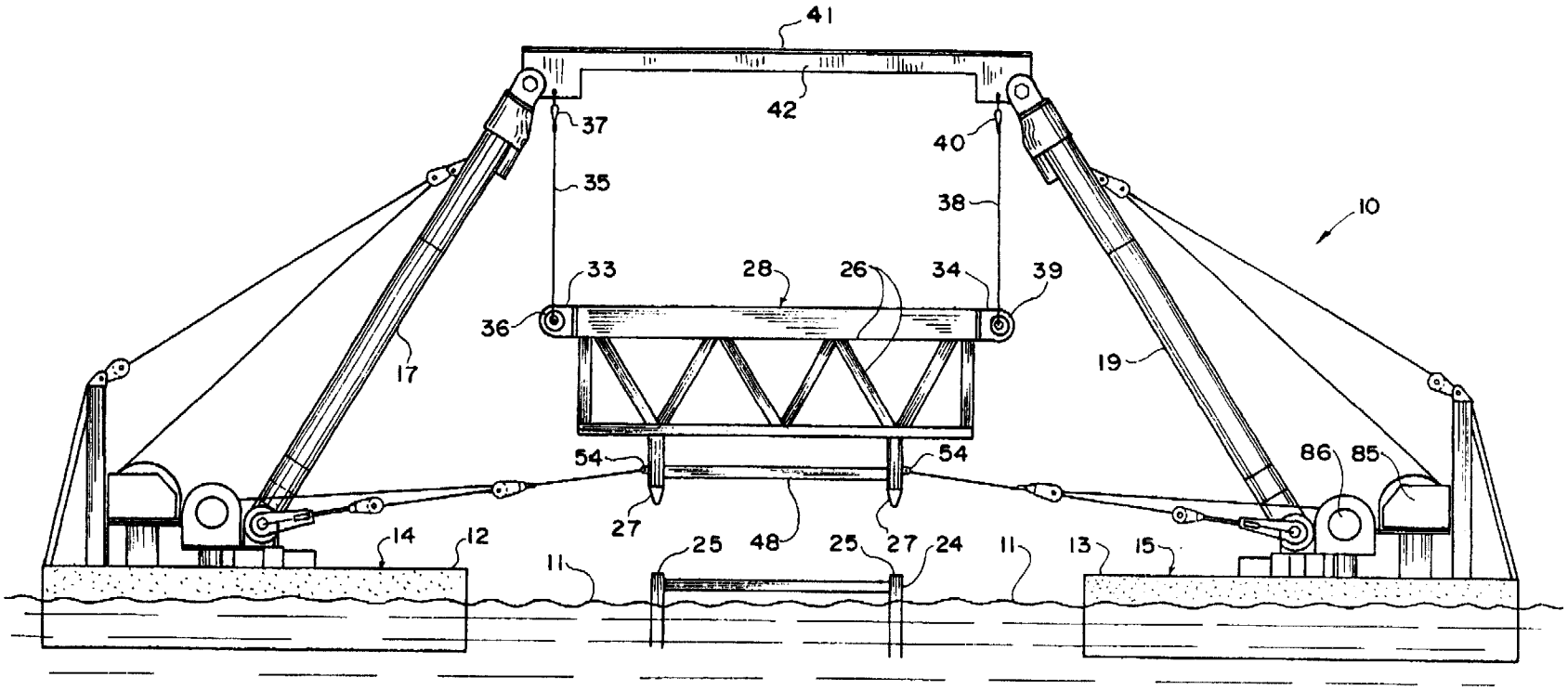
FIG. 2 is a side elevational view of the preferred embodiment of the apparatus of the present invention immediately prior to placement of the deck package on a jacket foundation.
Figure 3:
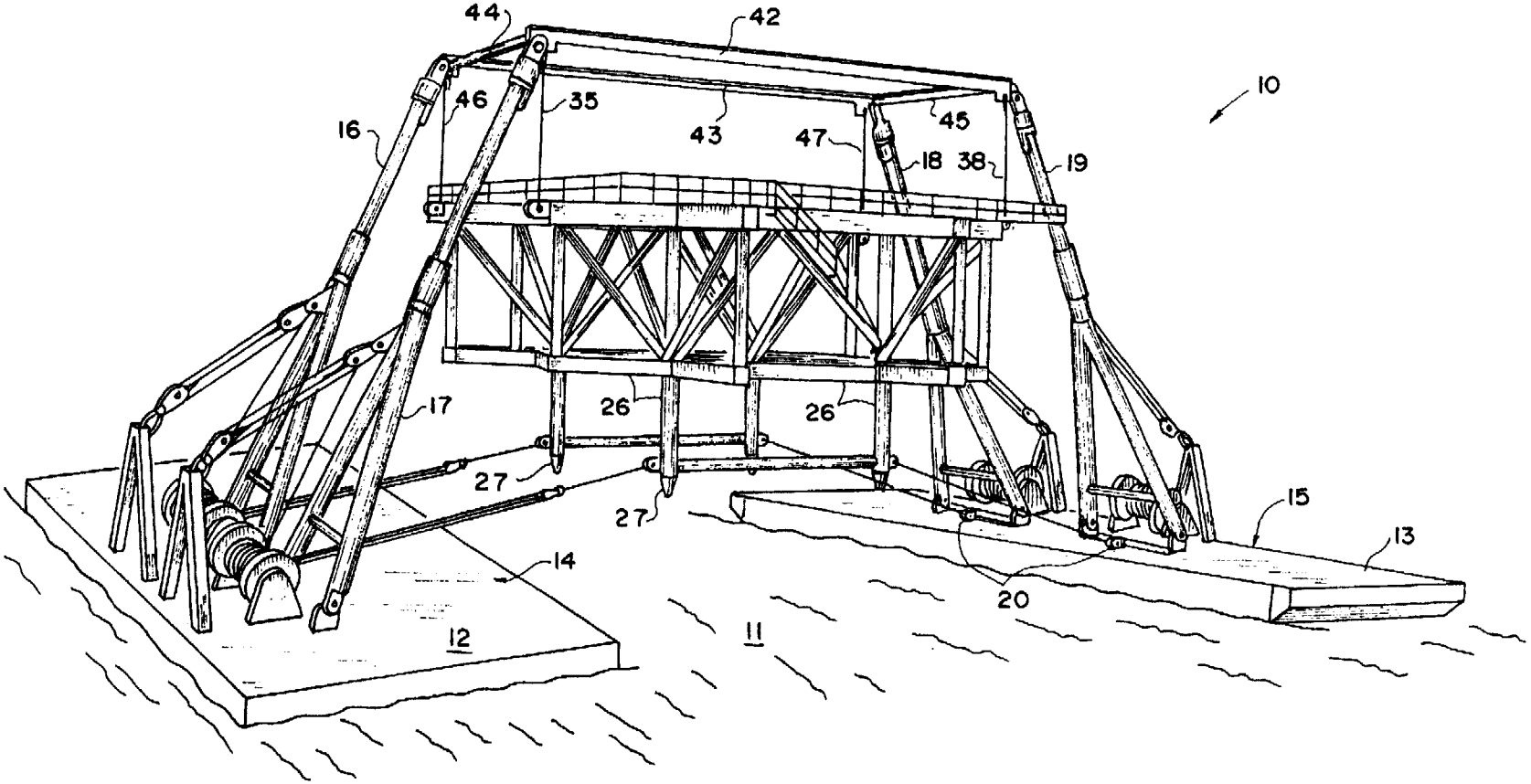
FIG. 3 is a perspective view of the preferred embodiment of the apparatus of the present invention illustrating the deck package in an elevated, lifted position.

FIGS. 1–3 show generally the preferred embodiment of the apparatus of the present invention designated generally by the numeral 10. Lifting apparatus 10 uses a pair of floating barges 12, 13 to lift a deck package or platform 26 (such as an oil and gas well drilling platform or production platform or the like) in a marine environment. In FIGS. 1–3, each of the barges 12, 13 is preferably a floating type marine barge that floats upon the water surface 11. Barges 12,13 can be standard size marine barges for example, measuring seventy two (72) feet wide and two hundred fifty (250) feet long or fifty four (54) feet wide and one hundred eighty (180) feet long.

For purposes of reference, FIG. 2 shows water surface 11, and a jacket 24 that is placed on the seabed and which extends above the water surface 11. Jackets 24 are known in the art. The construction of jacket 24 is conventional and known. Jacket 24 typically includes a base that is in some fashion mounted to the seabed. The jacket 24 also has an exposed portion that extends above the water surface 11. Jacket 24 can include a plurality of vertical columns extending above the water surface 11. Jacket 24 can also include a number of horizonal members that extend between the vertical columns. Diagonal members (not shown) can also be used to provide reinforcement for jacket as is known in the art.

Each of the vertical columns of jacket 24 provides a socket 25. The sockets 25 receive the lower end portion of the deck package 26 upon assembly. Deck package 26 includes a plurality of columns or vertical members 30, a plurality of horizonal members 31, 32 and diagonal members 29 as shown in FIG. 1. Typically, such deck packages 26 are prefabricated of structural steel in a fashion known in the art. Deck packages 26 usually provide an upper expansive structurally reinforced horizonal deck 28 that carries equipment, crew quarters, oil well drilling equipment, oil and gas well production equipment, drilling or production supplies and the like. The lower end portion of deck package 26 includes a plurality of conically shaped projections 27 that are sized and shaped to fit into and register upon the sockets 25 of jacket 24. Padeyes 33, 34 are usually provided during construction of deck package 26 for attaching a lifting device.

Figure 15:
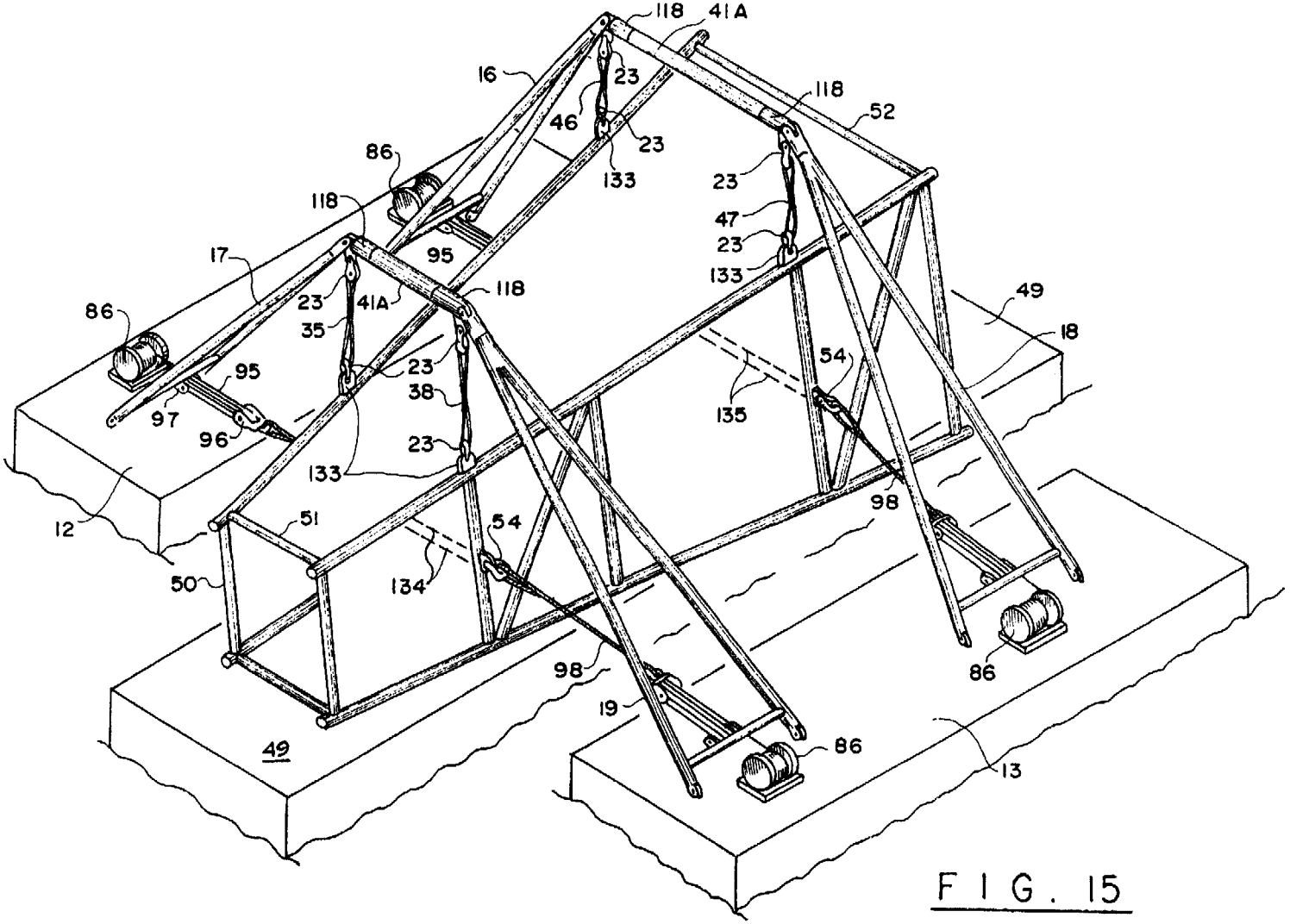
FIG. 15 is a perspective view of the preferred embodiment of the apparatus of the present invention illustrating the lifting of an offshore jacket foundation from a supporting transport barge.

In order to place deck package 26 on jacket 24, lifting apparatus 10 of the present invention is preferably attached to the deck package 26 after the deck package 26 has been floated to the site of jacket 24 using a transport barge or the like. In FIG. 15, a transport barge 49 is used to transport a new jacket 50 to a marine location for installation. In FIGS. 1–3, a jacket 24 is an existing, installed jacket. In order to lift the deck package 26 from its transport barge, upper and lower connections are formed between each barge 12, 13 and the deck package 26 to be lifted. In FIGS. 1–3, connections are made between deck package 26 and four inclined booms 16–19 connected together using frame 41 using wire rope or like slings 35, 38, 46,47. Such slings are commercially available. Each sling, such as sling 38 in FIG. 1, can have loops 21, 22 at its end portions 39, 40 and can be affixed to frame 41 and deck package 26 (at padeye 34) using shackles 23 at each loop end 21, 22. The ends 36, 37 of sling 35 are similarly connected between frame 41 and padeye 33. Such connections are made with slings 46, 47. In FIGS. 1–3, a plurality of lower connections are perfected at padeye connections 54 by spanning from winch 86 to padeye connection 54 using cables 95, 98.

In order to lift the deck package 26, each barge 12, 13 is provided with a plurality of lifting booms 16, 17 and 18, 19. In the preferred embodiment, a pair of lifting booms 1617 are attached with a pinned, pivot connection 20 to the upper deck 14 of barge 12. A pair of lifting booms 18–19 are attached with a pinned pivot connection 20 to the upper deck 15 of barge 13. Each of the lifting booms 16–19 is preferably of substantially identical construction, configuration and size. In FIGS. 7–14, the particular construction of a lift boom 16 is shown. However each boom 16–19 is preferably of substantially identical construction.

Each lifting boom 16–19 includes an upper end portion 60 that can form a releasable, quick-connect pinned connection with compression frame or member 41. Lifting booms 16–19 includes a lower end portion that is connected with a pinned connection to its barge 12 or 13. The upper end portion 60 of each lifting boom 16–19 provides a free end 62 having a flat tip 65. The end portion 60 can include a frustroconical tip 63 with an outer surface 64. Each end portion 60 connects to a correspondingly shaped socket 114 of a bell connector 108 (see FIGS. 12–14) mounted to (e.g., pinned to or bolted to) the compression member 41 (see FIG. 1). A compression member 41 in the form of a rectangular frame having beams 42–45 is pinned to the lifting booms 16–19 as shown in FIGS. 1, 2, and 3.

Figure 8:
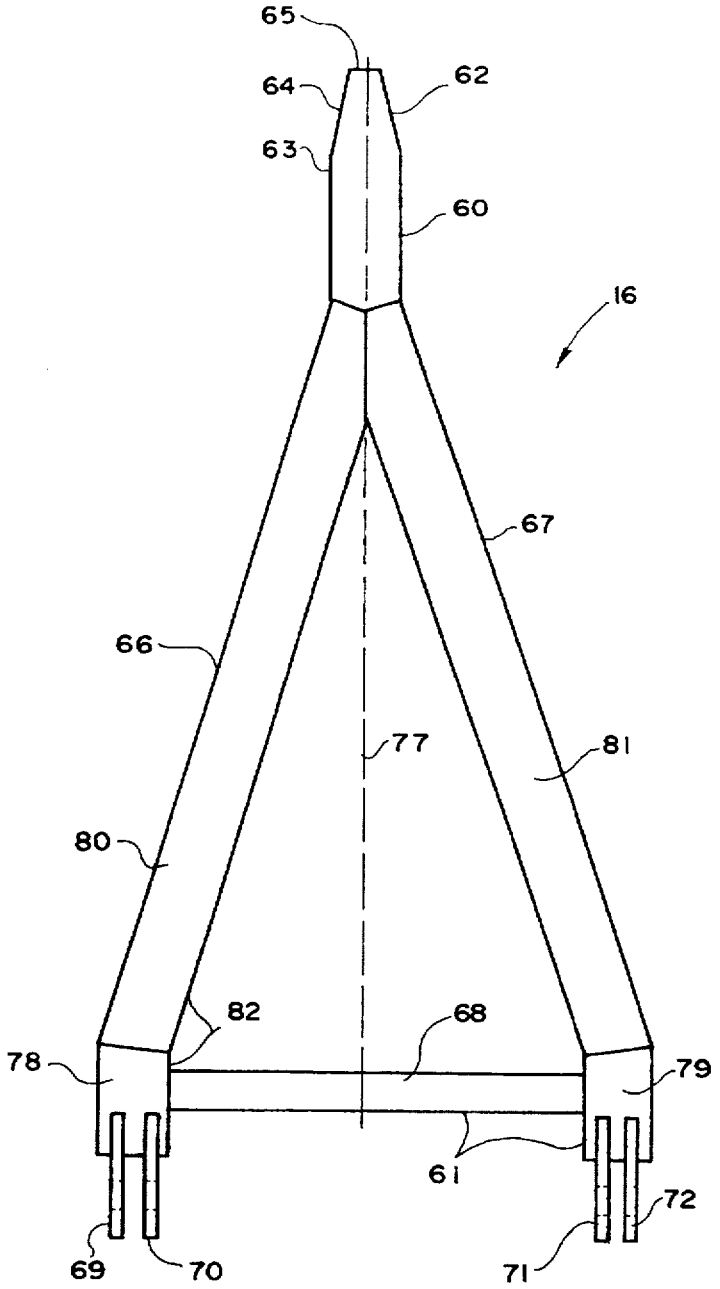
FIG. 8 is a fragmentary plan view of the preferred embodiment of the apparatus of the present invention illustrating the lifting boom portion thereof.
Figure 9:
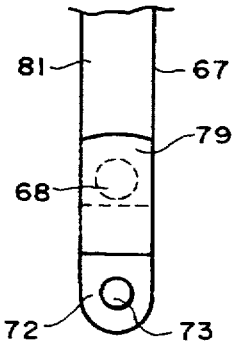
FIG. 9 is a fragmentary side view of the lifting boom of FIG. 8.

In FIGS. 8–9, each boom 16–19 is comprised of a pair of boom longitudinal members 66–67 and boom transverse member 68.

Each boom 16–19 attaches to its barge 12 or 13 using boom padeyes 69–72 at the lower end 61 of each boom. Each padeye 69–72 has a circular opening 73 that receives a cylindrical pin 83. A plurality of correspondingly shaped deck padeyes 84 are provided on the barge 11 so that a pinned connection can be formed between the padeyes 69–72 of each boom 16–19 and the padeyes 84 of the respective barge 12 or 13 using cylindrical pivot pin 83.

Reference line 77 in FIGS. 8 is the central longitudinal axis of upper cylindrical portion 60 of each lifting boom 16–19. Reference line 77 is also perpendicular to the central longitudinal axis of boom transverse member 68. Each of the padeyes 69–72 is preferably a flat planar padeye member that is parallel to reference line 77. Similarly, each deck padeye 84 is a flat plate member that is parallel to reference line 77. Pin 83 is perpendicular to reference line 77. Longitudinal members 66–67 each include short and long portions. The boom longitudinal member 66 includes short sections 78 and long section 80. The boom longitudinal member 66 includes short section 79 and long section 81. An obtuse angle 82 is formed between each of the short sections 78, 79 and its respective long section 80, 81.

In FIGS. 1–3 and 7, there can be seen a pair of winches 85, 86. Each winch 85, 86 can be a commercially available winch such as the Skaggitt RB90 or Amcom 750. Such winches are very powerful, having a single line pull of about one hundred fifty thousand (150,000) pounds for example. Sheaves are then used to increase the overall horizontal pulling capacity of the system as required from job to job.

Each winch 85, 86 is structurally mounted to its respective barge 12, 13 with a pedestal. Winch 85 is mounted upon pedestal 87. Winch 86 is mounted upon pedestal 88. In FIG. 1, the winch 85 is wound with an elongated cable 89 that is routed through sheave 90 and sheave 92 as many times as necessary to develop the capacity to raise or lower the respective boom 16–19. A padeye 91 is mounted at the upper end 60 of each lift boom 16 as shown in FIG. 1. Sheave 90 mounts to padeye 91 as shown. The sheave 92 is mounted upon padeye 93 at the upper end of backstay 94. The winch 95 as rigged in FIG. 1 can be used to raise and lower the desired lift boom 16–19 as the particular lift boom 16–19 rotates about pin 83. However, during actual lifting of the deck package 26, the cable 89 is not required and is slack until time of disconnection. Winch 86 is mounted upon pedestal 88. Elongated cable 95 is wound upon winch 86. The cable 95 is rigged to sheave 96 and sheave 97. The sheave 96 connects to the deck package 36 at the connections 54.

Figure 7:
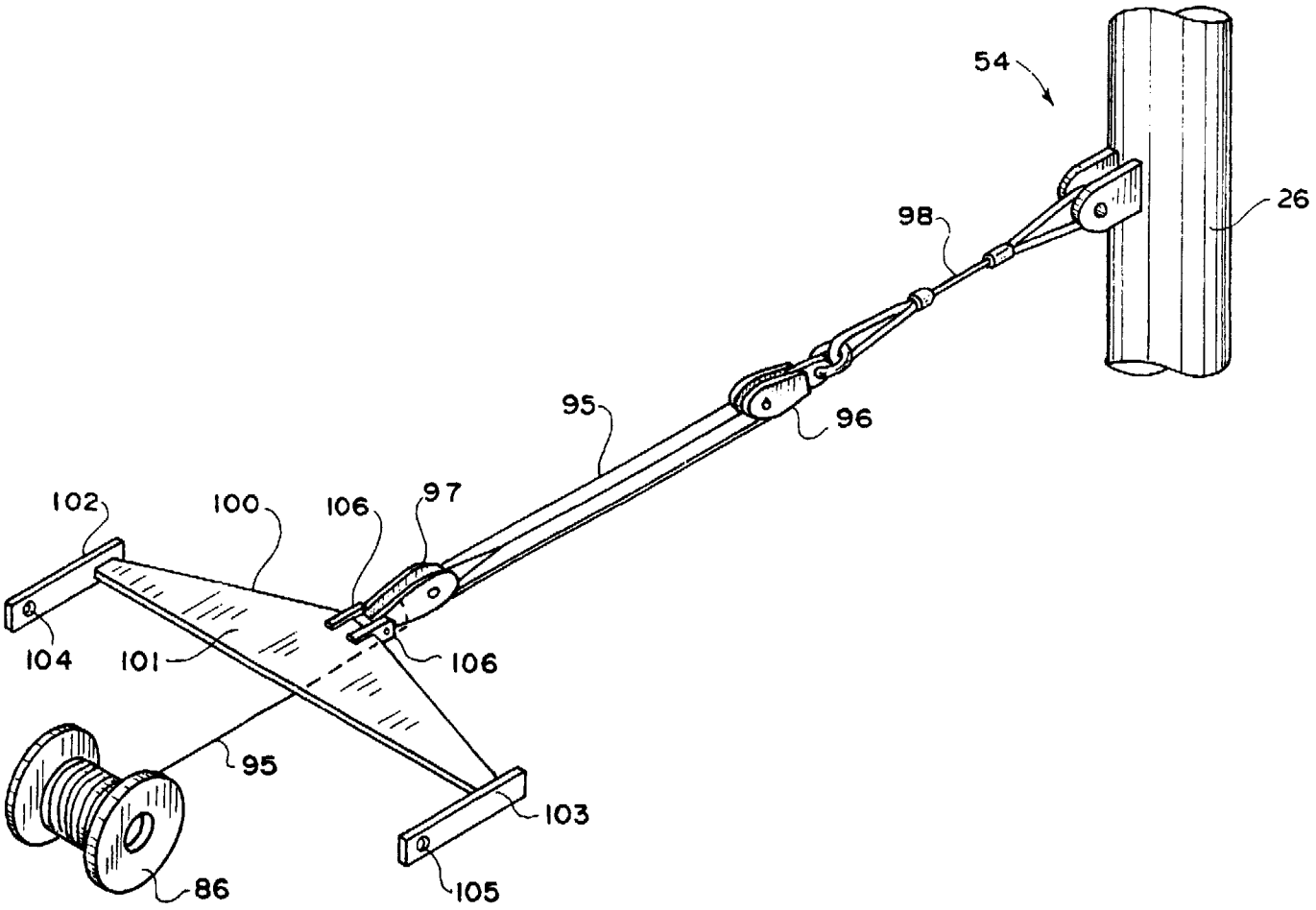
FIG. 7 is a fragmentary perspective view of the preferred embodiment of the apparatus of the present invention illustrating the winch and extensible cable portions thereof.

In FIG. 7, a typical rigging between winch 86 and a vertical column 30 of deck package 26 is shown. The winch 86 is wound with the elongated cable 95 that is routed through sheaves 96 and 97 as many times as necessary to develop the load required during lifting of deck package 26. Cable section 98 can be sized to carry the entire tensile load between padeye connection 54 and winch 86. The sheave 96 attaches to cable section 98. The cable section or sling 98 is attached to padeye connections 54. The sheave 97 is attached to spreader plate 100 at padeye 106, each having an opening 107 for receiving a pin so that the user can form a connection between the sheave 97 and the plate 100 at padeyes (see FIGS. 7, and 10–11).

Figure 10:
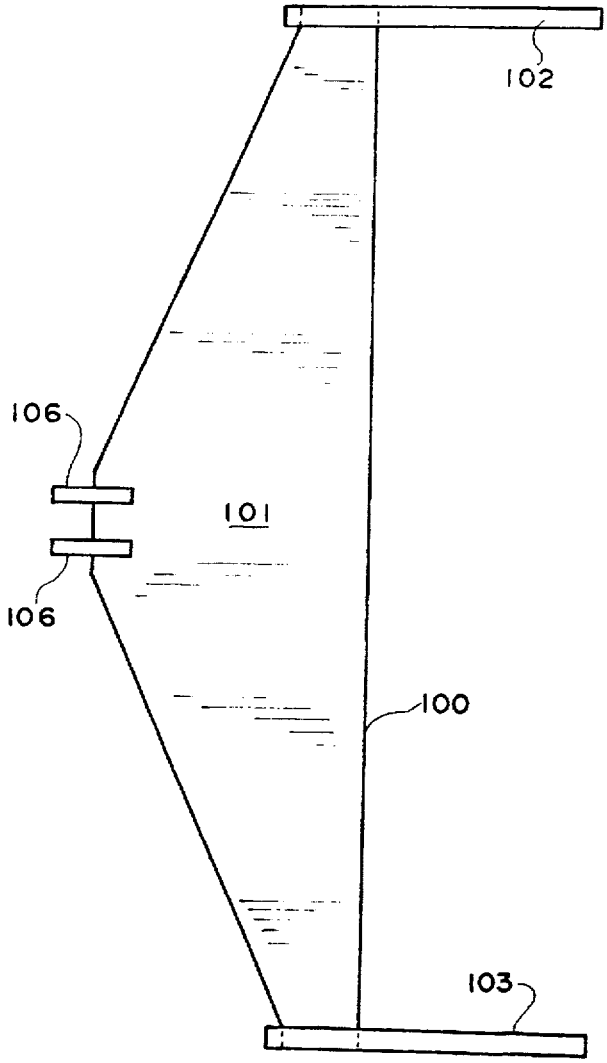
FIG. 10 is a top plan fragmentary view of a portion of the extensible cable arrangement of FIG. 7 showing the spreader plate portion thereof.
Figure 11:
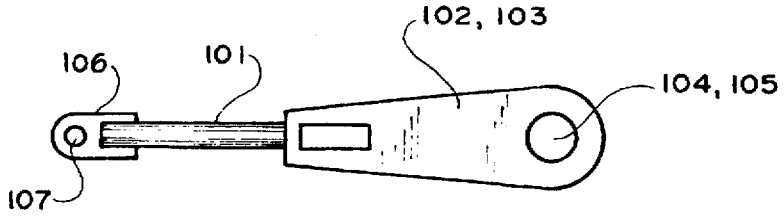
FIG. 11 is a side view of the spreader plate of FIG. 10.
Figure 12:
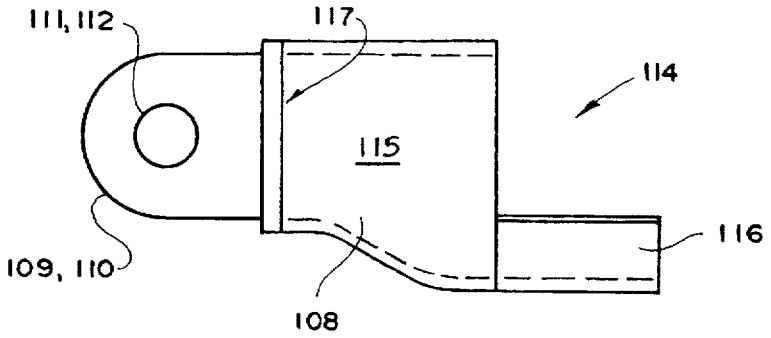
FIG. 12 is an elevational view of the bell portion of the preferred embodiment of the apparatus of the present invention.
Figure 14:
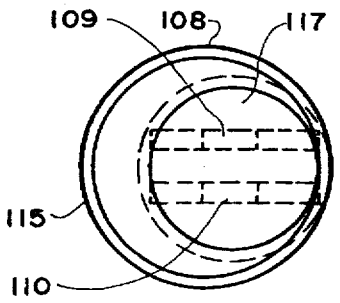
FIG. 14 is an end view of the bell portion of FIGS. 12 and 13.
Figure 13:
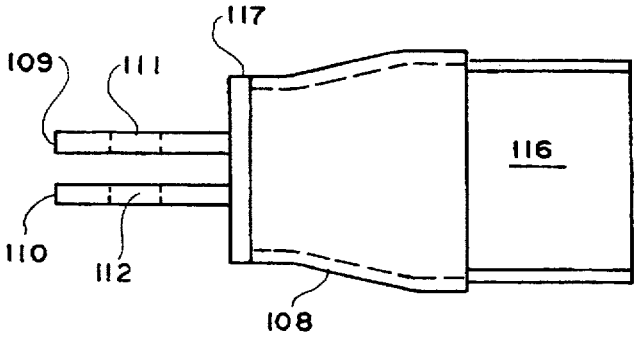
FIG. 13 is a plan view of the bell portion of FIG. 12.

In FIGS. 7 and 10–11, spreader plate 100 is shown more particularly. The spreader plate 100 includes a triangular plate section 101 with a pair of transverse plate members 102, 103 mounted to the end portions of the triangular plate 101. Each of the transverse plates 102, 103 provides an opening for attaching the spreader plate 100 at its openings 104, 105 to the barge padeyes 84. The openings 104, 105 thus provide a reference for alignment. When the openings 104, 105 are used to attach the spreader plate 100 to pin 83 at barge padeyes 84, this arranges the plates 102, 103 parallel to reference line 77 and perpendicular to the central longitudinal axis of pin 83. Further, the padeyes 106 are spaced an equal distance from each of the transverse plates 102, 103 namely at the center of triangular plate section 101. Openings 107 in plates 106 allow attachment of sheave 97 thereto. The above arrangement functions to center the winch cable 95 and the cable section 98 on the center of the winch 86.

During use, the winch 86 can thus be used to pay out or to pull in cable 95 thus determining the distance between each of the barges 12, 13 and the deck package 26 to be lifted. Further, the horizontal member 48 of deck package 26 is at the same elevation as the padeye connections 54. In this fashion, the deck package 26 at member 48 carries the tensile load that is transmitted to the deck package 26 by the cable 95 and cable sections 98.

The present invention can provide a quick connect, quick disconnect method and apparatus for forming a connection between each lifting boom 16–19 and the compression frame 41. Slings suspend and support the package, eliminating undue horizontal stresses that a particular package might not be able to handle. In FIGS. 1–2 and 12–14, there can be seen a bell connector 108 that is pinned or bolted to the compression frame 41. The bell 108 is shown more particularly in FIGS. 10–12. Each bell 108 provides a pair of spaced apart padeyes 109, 110. Each padeye 109, 110 provides an opening 111, 112 respectively. Openings 111, 112 allow a pinned or bolted pivoting connection to be formed between each bell connector 108 and compression member 41. The bell 108 provides a socket 114 that receives the closely fitting cone end portion 63 of each lifting boom 16–19. A surrounding side wall 115 is sized and shaped to conform and fit the outer surfaces 64, 65 of conical end 62 of each boom 16–19. A projecting curved wall portion 116 extends away from the portion 115 as shown in FIGS. 10 and 11. The curved wall portion 116 extends about 120° rather than a full 360° about wall 115. This allows the conical end portion 62 of each boom 16–19 to engage the member 116 as a point of reference before entering the socket 114. End plate 117 extends transversely. Padeyes 109, 110 are mounted to end plate 117. The side wall 115 extends from the opposite side of end plate 117. Bell 108 can be of welded, structural steel construction. The socket 114 closely conforms in size and shape to the frustroconical tip 63 of each lifting boom 16–19. The flat end portion 65 of each lifting boom 56–59 bears against flat plate 117. In FIGS. 1–3, each of the lifting booms 16–19 has engaged a bell connector 108 that is pinned to compression frame 41.

Winch 86 can be used to lower a package 26 into position on a selected jacket 24. The winch 86 can also be used to raise a deck package 26 that is already supported upon a jacket 24. For example, obsolete or abandoned deck platforms 26 can be removed from a jacket 24 using the method and apparatus of the present invention as described above.

In an alternate construction of FIGS. 4–6, and 15, the compression member is in the form of two spreader bars 41A, each with a pair of opposed removable end caps 118. Spreader bar 41A can be a section of cylindrical hollow pipe of uniform diameter. Such spreader bars as 41A are shown and described in U.S. Pat. No. 4,397,493 and U.S. Pat. No. 4,538,849, each incorporated herein by reference. In FIG. 6, each end cap 118 has a cylindrical sleeve 119 with a cylindrical socket 120 that is correspondingly shaped to receive the outer surface of spreader bar 41A end portion (see arrow 132). The end 127 of bar 41A stops at stop plate 126 that defines the inner end of socket 120.

End cap 118 has a pair of plates 121, 122 that are generally parallel to one another and to the central longitudinal axis of sleeve portion 119. A space 123 between plates 121, 122 receives slings 35, 38 and 46–47. End caps 118 can be formed with one plate 121 centered on the central longitudinal axis of sleeve 119 (see FIG. 15). In that case, shackles 23 can be used to form connections between a sling 35, 38, 46–47 and an end cap 118. This arrangement is also disclosed in the above-referenced U.S. Pat. No. 4,397,493 and U.S. Pat. No. 4,538,849.

In FIG. 6, each plate 121, 122 has an upper opening 124 and a lower opening 125. Pins 128, 129 fit through the respective pairs of openings 124, 125, through the loop end 21 of sling 38, and through the opening 111 of a plate 109 of bell 108. If end cap 118 has two plates, 121, 122 as shown in FIGS. 4, bell 108 has only one plate 109 that is centered on the central longitudinal axis of socket 114. If end cap 114 has one plate centered on the central longitudinal axis of sleeve 118, bell 108 has two plates 109, 110 that are positioned on opposite sides of the single plate 121 of end cap 118. The openings 124, 125 are preferably vertically aligned. In FIG. 5, arrows 130, 131 schematically illustrate the insertion of pins 128, 129 through the upper and lower respective openings 124, 125. Pins 128, 129 can be bolted connections.

FIG. 15 shows a new jacket foundation 50 being lifted from its transport barge 49 using the method and apparatus 10 of the present invention. Padeyes 133 are provided on the legs of jacket 49 that face up when the jacket 49 lies on its side on barge 49. Transverse members 134, 135 are provided at padeye connections 54 to transmit tensile load, similarly to the member 48 in FIG. 2. One the jacket 50 is lifted, the transport barge 49 can be removed. Jacket 50 is then disconnected and floated before its final installation. Thereafter, installation of jackets (such as 50) from a floating position to vertical position that supports the jacket on the seabed is well known.

Figure 16:
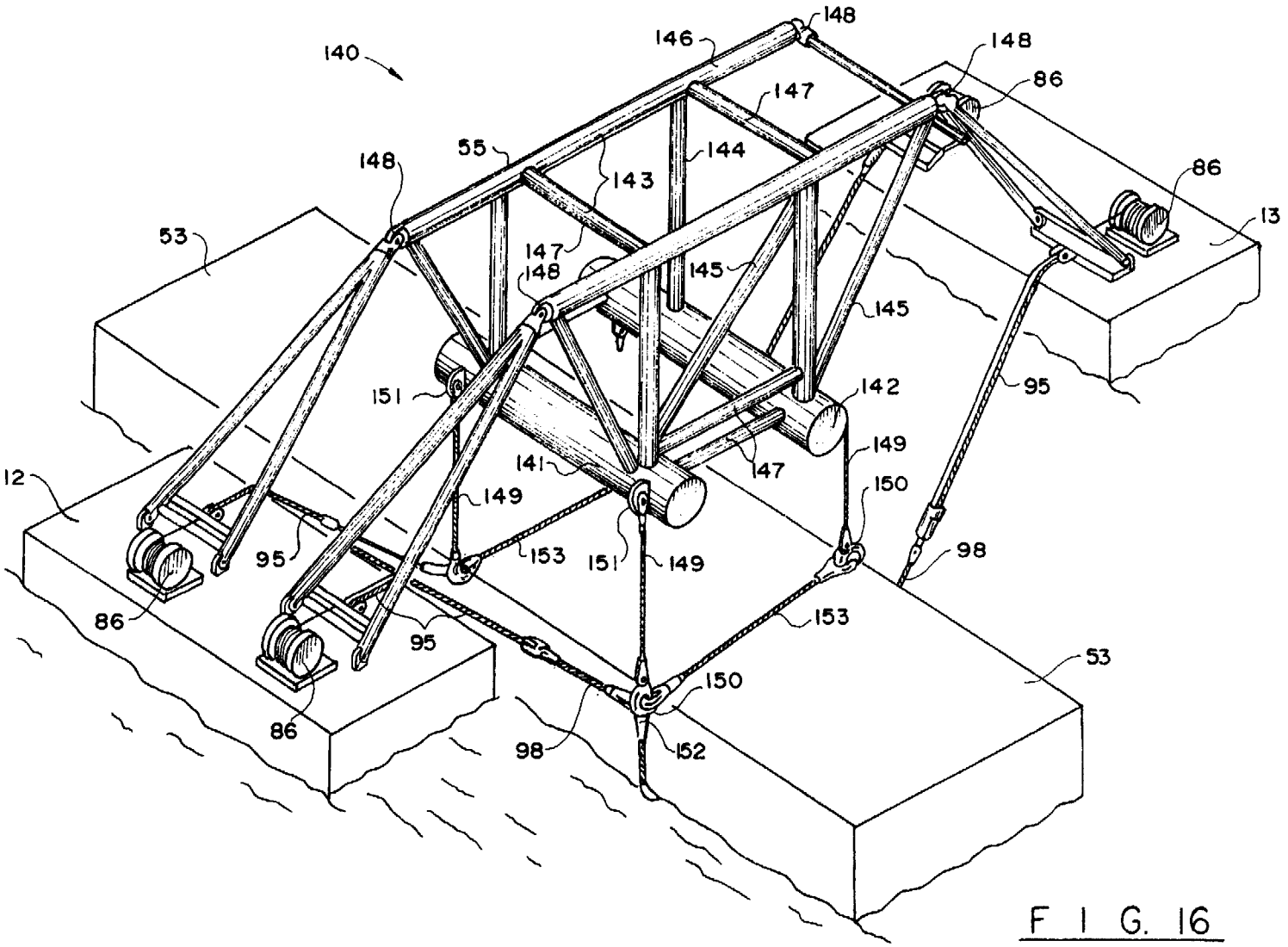
FIGS. 16–17 are sequential views illustrating the method and apparatus of the present invention during the lifting of a sunken vessel, employing an alternate construction of the compression member in the form of a float-over lift frame.
Figure 17:
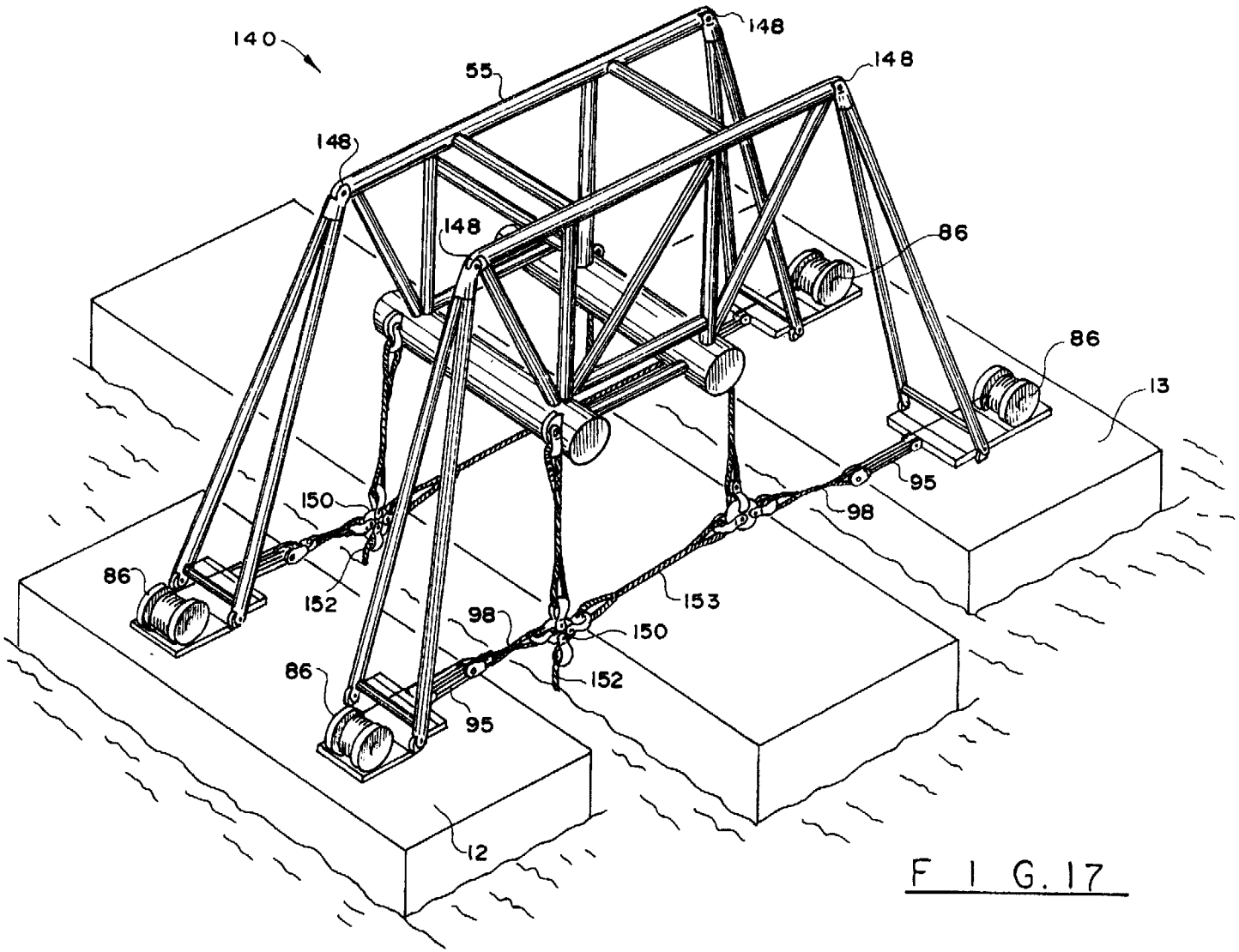

FIGS. 16–17 show an additional embodiment of the method and apparatus of the present invention, designated by the numeral 140. In FIGS. 16–17, the lifting apparatus 140 functions like the embodiment of FIGS. 1–3, with the difference being the use of float-over lift frame 55 to replace the compression frame 41 of FIGS. 1–3. Frame 55 includes a pair of spaced-apart floating pontoons 141, 142 supporting a superstructure 143 comprised of multiple vertical members 144, multiple diagonal members 145 and a pair of elongated horizontal beam members 146 and multiple horizontal struts 147.

The barges 12, 13 and booms 16–19 and winch and cable members are the same as shown in FIGS. 1–3 and 7–14. Pinned connections 148 attach the free end of each boom 16–19 at a bell 108 to frame 55. Four slings 149 depend from frame 55 to sunken vessel 53. Each sling 149 is connected at a padeye connection 151 to frame 55. Each sling 149 also connects to a plate 150 using shackles for example. Slings 152 extend from one plate 150 to another opposed plate 150 (see FIG. 17) and under the sunken vessel 53. In effect, the slings 152 cradle the sunken vessel 53 at intervals along the length of the vessel. The slings 153 are tensile members during lifting. A sling 153 extends from one plate 150 to an opposed plate 150 (see FIG. 17) over the sunken vessel. Shackles can form the connections between the ends of slings 153 and opposed plates 150. The sunken vessel 53 is lifted by shortening the cable 95 using winch 86 as with the embodiment of FIGS. 1–3. In FIG. 16, the sunken vessel 53 has been rigged for the lift. In FIG. 17, the lift is complete placing the sunken vessel 53 at the water's surface.

The following table lists the parts numbers and parts descriptions as used herein and in the drawings attached hereto.

PARTS LIST

| Part Number | Description |
|---|---|
| 10 | lifting apparatus |
| 11 | water surface |
| 12 | barge |
| 13 | barge |
| 14 | deck |
| 15 | deck |
| 16 | boom |
| 17 | boom |
| 18 | boom |
| 19 | boom |
| 20 | pinned connection |
| 21 | loop |
| 22 | loop |
| 23 | shackle |
| 24 | jacket |
| 25 | socket |
| 26 | deck package |
| 27 | projection |
| 28 | upper surface |
| 29 | diagonal member |
| 30 | vertical member |

-continued

PARTS LIST

| Part Number | Description |
|---|---|
| 31 | horizontal member |
| 32 | horizontal member |
| 33 | padeye |
| 34 | padeye |
| 35 | sling |
| 36 | lower end |
| 37 | upper end |
| 38 | sling |
| 39 | lower end |
| 40 | upper end |
| 41 | compression member |
| 41A | spreader bar |
| 42 | beam |
| 43 | beam |
| 44 | beam |
| 45 | beam |
| 46 | sling |
| 47 | sling |
| 48 | horizontal member |
| 49 | transport barge |
| 50 | jacket foundation |
| 51 | upper end |
| 52 | lower end |
| 53 | sunken vessel |
| 54 | padeye connection |
| 55 | frame |
| 60 | upper cylindrical portion |
| 61 | lower end portion |
| 62 | free end |
| 63 | frustroconical tip |
| 64 | frustroconical surface |
| 65 | flat end portion |
| 66 | boom longitudinal member |
| 67 | boom longitudinal member |
| 68 | boom transverse member |
| 69 | padeye |
| 70 | padeye |
| 71 | padeye |
| 72 | padeye |
| 77 | reference line |
| 78 | short section |
| 79 | short section |
| 80 | long section |
| 81 | long section |
| 82 | angle |
| 83 | pin |
| 84 | deck padeye |
| 85 | winch |
| 86 | winch |
| 87 | pedestal |
| 88 | pedestal |
| 89 | cable |
| 90 | sheave |
| 91 | padeye |
| 92 | sheave |
| 93 | padeye |
| 94 | backstay |
| 95 | cable |
| 96 | sheave |
| 97 | sheave |
| 98 | cable section |
| 100 | spreader plate |
| 101 | triangular plate section |
| 102 | transverse plate |
| 103 | transverse plate |
| 104 | opening |
| 105 | opening |
| 106 | padeye |
| 107 | opening |
| 108 | bell |
| 109 | padeye |
| 110 | padeye |
| 111 | opening |
| 112 | opening |
| 113 | padeye |
| 114 | socket |

-continued

PARTS LIST

| Part Number | Description |
|---|---|
| 115 | side wall |
| 116 | member |
| 117 | end plate |
| 118 | end cap |
| 119 | cylindrical sleeve |
| 120 | cylindrical socket |
| 121 | plate |
| 122 | plate |
| 123 | space |
| 124 | upper openings |
| 125 | lower openings |
| 126 | transverse stop plate |
| 127 | end |
| 128 | pin |
| 129 | pin |
| 130 | arrow |
| 131 | arrow |
| 132 | arrow |
| 133 | padeyes |
| 134 | transverse member |
| 140 | lifting apparatus |
| 141 | pontoon |
| 142 | pontoon |
| 143 | superstructure |
| 144 | vertical member |
| 145 | diagonal member |
| 146 | horizontal beam |
| 147 | horizontal strut |
| 148 | pinned connection |
| 149 | sling |
| 150 | plate |
| 151 | padeye connection |
| 152 | sling |
| 153 | sling |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A lifting apparatus for lifting a multi-ton package such as a deck package, sunken vessel, or offshore jacket, comprising:

a) a pair of barges, each defining a base that can support a plurality of diagonally extending lift booms pivotally mounted thereon and a large multi-ton load;

b) a truss supported by the barges about the periphery of the package for forming a load transfer between the barges and the package to be lifted;

c) said truss including at least one compression frame member supported by the plurality of diagonally extending lift booms, each lift boom having a lower end attached to a barge and an upper end that can be attached to the compression frame member;

d) a plurality of cables that depend from the combination of truss and compression member, the cables having lower ends for holding the package; and f) the combination of the compression frame and booms enabling the cables to raise and lower the package.

2. The apparatus of claim 1 wherein the truss is a variable dimension truss means that includes booms and variable length truss members each spanning between two booms on opposing sides of the package.

3. The apparatus of claim 2 wherein there are two lifting booms and the barges have horizontal surfaces spaced generally on opposite sides of the package being lifted, each barge supporting a boom during lifting.

4. The apparatus of claim 1 wherein the truss is a variable dimension truss that includes two opposing truss members that are each pinned to a different one of the barges and which are angularly disposed with respect to each other during use, wherein caps form a detachable interface between the truss members and the compression frame member.

5. The apparatus of claim 1 wherein the truss includes a winch operated cable.

6. The apparatus of claim 4 wherein the variable dimension truss means includes a winch operating a cable.

7. The apparatus of claim 1 wherein each boom is an "A" frame shaped boom that comprises a pair of longitudinal boom members that form an acute angle, a pair of padeye members that form a detachable interface between each longitudinal boom member and a barge, a free end portion having a structural member with a projection thereon and a pair of end caps that form a detachable connection between the longitudinal boom members and the compression member.

8. The apparatus of claim 2 wherein the variable length members includes multiple winch and cable assemblies spaced along the upper deck surface of each barge.

9. A method for the offshore lifting of a multi-ton package such as a deck package, sunken vessel or jacket, comprising the steps of:

a) transporting a lifting assembly to a desired site of the package;

b) attaching a lifting assembly to the package at multiple positions including positions that are at least on generally opposite sides of the package, the lifting assembly including at least three chords, including a horizontal chord normally in tension during the lifting process which has a variable length and a diagonally extending chord normally in compression during the lifting process;

c) wherein in step "a" the lifting assembly includes two opposed lifting booms connected by at least one compression frame member that spans between upper end portions of the booms, a plurality of slings with end portions that respectively attach to the combination of booms and compression frame member;

d) structurally supporting the lifting assembly with one or more lift barges;

e) supporting the package with the slings; and f) lifting the package by changing the length of the horizontal chord of the lifting assembly.

10. The method of claim 9, wherein the package can be lowered by lengthening the horizontal chord.

11. The method of claim 9, wherein the lifting assembly can raise or lower the package once suspended below and supported by the slings.

12. The method of claim 10, wherein the horizontal chord includes a winch that is wound with a lift cable which winds/unwinds to change the length of the lift cable.

13. The method of claim 9, wherein there are two opposed lift barges that are floating barges.

14. The method of claim 9, wherein one portion of the lifting assembly includes a plurality of compression carrying diagonally extending lift booms, each with opposing end portions and a plurality of end caps that removably attach to the end portions wherein two of the end caps form a pinned connection with the compression member.

15. The method of claim 14, wherein each lift barge has a winch structurally mounted thereon and a lower connection formed with the package includes a flexible cable extending between the winch and the package.

16. The method of claim 15, wherein the lifting assembly includes a plurality of non-extensible diagonally extending lift booms, each removably connecting to an end cap and further comprising steps of connecting a plurality of the end caps to the compression member, and further comprising the step of connecting the booms to the end caps.

17. A method for the offshore lifting a multi-ton package such as a deck package, jacket or submerged vessel, comprising the steps of: a) transporting a lifting assembly to a desired site having the package;

b) attaching the lifting assembly to the package at multiple elevational positions on the package, including upper and lower positions that are at least on generally opposite sides of the package;

c) wherein the lifting assembly includes opposed floating barges having diagonally extending lifting booms thereon connected at their upper ends by a compression member and horizonal chords that can be varied in length and in step "b" vertical slings are used to attach the upper end portion of each of the diagonally extending lifting booms at the compression member to the package;

d) structurally supporting each of the lifting booms at the lower end portion thereof with one of the barges, each boom being pivotally attached to its barge;

e) wherein the package is supported by the slings depending from the upper end of the booms and the slings attaching to the package; and f) elevating the package by changing the length of the horizontal chord of each lifting assembly.

* * * * *